US009921593B2

(12) United States Patent
Gorecki et al.

(10) Patent No.: US 9,921,593 B2
(45) **Date of Patent: *Mar. 20, 2018**

(54) WIDEBAND LOW DROPOUT VOLTAGE REGULATOR WITH POWER SUPPLY REJECTION BOOST

(71) Applicant: INPHI CORPORATION, Santa Clara, CA (US)

(72) Inventors: James Lawrence Gorecki, Hillsboro, OR (US); Han-Yuan Tan, Santa Clara, CA (US)

(73) Assignee: INPHI CORPORATION, Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/374,983

(22) Filed: Dec. 9, 2016

(65) Prior Publication Data

US 2017/0126329 A1 May 4, 2017

Related U.S. Application Data

(63) Continuation of application No. 14/642,647, filed on Mar. 9, 2015, now Pat. No. 9,552,006.

(51) Int. Cl.
*G05F 1/565* (2006.01)
*G05F 1/575* (2006.01)

(52) U.S. Cl.
CPC ..... *G05F 1/565* (2013.01); *G05F 1/575* (2013.01)

(58) Field of Classification Search
CPC ... G05F 1/46; G05F 1/462; G05F 1/56; G05F 1/561; G05F 1/565; G05F 1/575
See application file for complete search history.

(56) References Cited

U.S. PATENT DOCUMENTS 8,165,297 B2 * 4/2012 Hoffmann ..... H04L 9/3263 380/256
2005/0248326 A1 * 11/2005 Bo ..... G05F 1/575 323/274

(Continued)

OTHER PUBLICATIONS

Cheng-Chung Hus et al., "An 11 b 800MS/s Time-Interleaved ADC wth Digital Background Calibration", Proceedings of the 2007 International Solid State Circuit Conference, Feb. 14, 2007, pp. 464-465, 615.

(Continued)

*Primary Examiner* — Kyle J Moody
(74) *Attorney, Agent, or Firm* — Richard T. Ogawa; Ogawa P.C.

(57) ABSTRACT

The present disclosure provides a detailed description of techniques for implementing a wideband low dropout voltage regulator with power supply rejection boost. More specifically, some embodiments of the present disclosure are directed to a voltage regulator comprising a voltage regulator core powered by a supply voltage and providing a regulated voltage output, and a power supply feed forward injection module delivering an injection signal to the voltage regulator core to effect a power supply rejection of the supply voltage variation from the regulated voltage. In one or more embodiments, the injection signal is determined from the supply voltage variation and a gain factor that is based on various design attributes of the output stage of the voltage regulator core. In one or more embodiments, the power supply feed forward injection module comprises a supply voltage sense circuit, a low pass filter, and one or more selectable transconductance amplifiers.

20 Claims, 10 Drawing Sheets

(56) References Cited

U.S. PATENT DOCUMENTS

| | | | | |
|---|---|---|---|---|
| 2014/0176098 | A1* | 6/2014 | Fang | G05F 1/575 323/280 |
| 2014/0266444 | A1* | 9/2014 | Scott | H03F 1/0227 330/257 |
| 2015/0077070 | A1* | 3/2015 | Fazeel | G05F 1/575 323/265 |
| 2016/0026199 | A1* | 1/2016 | El-Nozahi | G05F 1/575 323/274 |
| 2017/0126217 | A1* | 5/2017 | Gorecki | H03K 5/023 |
| 2017/0207864 | A1* | 7/2017 | Gorecki | H04B 17/21 |

OTHER PUBLICATIONS

Sandeep Gupta et al., "A 1GS/s 11b Time-Interleaved ADC in 0.13μm CMOS", Proceedings of the 2006 International Solid State Circuit Conference, Feb. 8, 2006, Session 31-6.

Shahriar Shahramian et al., "A 30-GS/s Track and Hold Amplifier in 0.13-μm CMOS Technology", IEEE 2006 Custom Integrated Circuits Conference, 2006, pp. 493-496.

Simon Louwsma et al., "A Time-Interleaved Track & Hold in 0.13μm CMOS sub-sampling a 4 GHz Signal with 43dB SNDR", IEEE 2007 Custom Integrated Circuits Conference, 2007, pp. 329-332.

Francesco Centurelli et al., "Design Solutions for Sample-and-Hold Circuits in CMOS Nanometer Technologies", IEEE Transactions of Circuits and Systrems-II: Express Briefs, , Jun. 2009, pp. 459-463, vol. 56, No. 6.

Tang Kai et al., "A 20GSps Track-and-Hold Circuit in 90nm CMOS Technology", 2012 International Conference on Advanced Technologies for Communications, 2012, pp. 237-240.

* cited by examiner

WIDEBAND LOW DROPOUT VOLTAGE REGULATOR WITH POWER SUPPLY REJECTION BOOST

The present application is a continuation of and claims priority to U.S. patent application Ser. No. 14/642,647, entitled "WIDEBAND LOW DROPOUT VOLTAGE REGULATOR WITH POWER SUPPLY REJECTION BOOST", filed Mar. 9, 2015, which is hereby incorporated by reference in its entirety.

FIELD

This disclosure relates to the field of voltage regulators and more particularly to techniques for wideband low dropout voltage regulator with power supply rejection boost.

BACKGROUND

Voltage regulators are an increasingly more important and vital component in today's power sensitive electronic systems. Specifically, mobile systems (e.g., in smart phones, tablets, etc.) relying on a finite power source (e.g., battery) might have a dozen or more voltage regulators that provide a targeted power supply level to each subsystem such that the power consumption of the overall system is optimized. Further, high speed data communication systems (e.g., 100 Gigabit Ethernet) might also implement voltage regulators that exhibit a wide bandwidth and high power supply rejection (PSR) to not only manage power consumption, but also to block or "reject" power supply voltage variations (e.g., switching noise from one or more system switching regulators) from the data signals on the data receive channels.

More specifically, such high speed data communication systems might deploy one or more low dropout (LDO) voltage regulators that exhibit a high PSR performance in a frequency range of 100 kHz to 100 MHz. Legacy LDO voltage regulator designs approach a high PSR in this range by implementing a high gain and high bandwidth front end operational amplifier (e.g., error amplifier). However, this technique increases the power consumption and noise of the LDO voltage regulator. Further, such techniques require a large amount of decoupling capacitance at the LDO voltage regulator output to suppress the peak PSR, adding costly die area to the design.

Techniques are needed to address the problem of implementing a wideband low dropout voltage regulator that exhibits high power supply rejection, and low power and low die area consumption, enabling the advancement of high speed data communication systems and other electronic systems.

None of the aforementioned legacy approaches achieve the capabilities of the herein-disclosed techniques for a wideband low dropout voltage regulator with power supply rejection boost. Therefore, there is a need for improvements.

SUMMARY

The present disclosure provides improved techniques to address the aforementioned issues with legacy approaches. More specifically, the present disclosure provides a detailed description of techniques for implementing a wideband low dropout voltage regulator with power supply rejection boost. The claimed embodiments address the problem of implementing a wideband low dropout voltage regulator that exhibits high power supply rejection, and low power and low die area consumption. More specifically, some claims are directed to approaches for providing power supply feed-forward injection configured to offset the effects of power supply voltage variations on the voltage regulator output, which claims advance the technical fields for addressing the problem of implementing a wideband low dropout voltage regulator that exhibits high power supply rejection, and low power and low die area consumption, as well as advancing peripheral technical fields. Some claims improve the functioning of multiple systems within the disclosed environments.

Some embodiments of the present disclosure are directed to a voltage regulator comprising a voltage regulator core powered by a supply voltage and providing a regulated voltage output, and a power supply feed forward injection module delivering an injection signal to the voltage regulator core to effect a power supply rejection of the supply voltage variation from the regulated voltage. In one or more embodiments, the injection signal is determined from the supply voltage variation and a gain factor that is based on various design attributes of the output stage of the voltage regulator core. In one or more embodiments, the power supply feed forward injection module comprises a supply voltage sense circuit, a low pass filter, and one or more selectable transconductance amplifiers, to provide an injection current to the voltage regulator core.

Further details of aspects, objectives, and advantages of the disclosure are described below and in the detailed description, drawings, and claims. Both the foregoing general description of the background and the following detailed description are exemplary and explanatory, and are not intended to be limiting as to the scope of the claims.

BRIEF DESCRIPTION OF THE DRAWINGS

The drawings described below are for illustration purposes only. The drawings are not intended to limit the scope of the present disclosure.

DETAILED DESCRIPTION

Figure 1A:
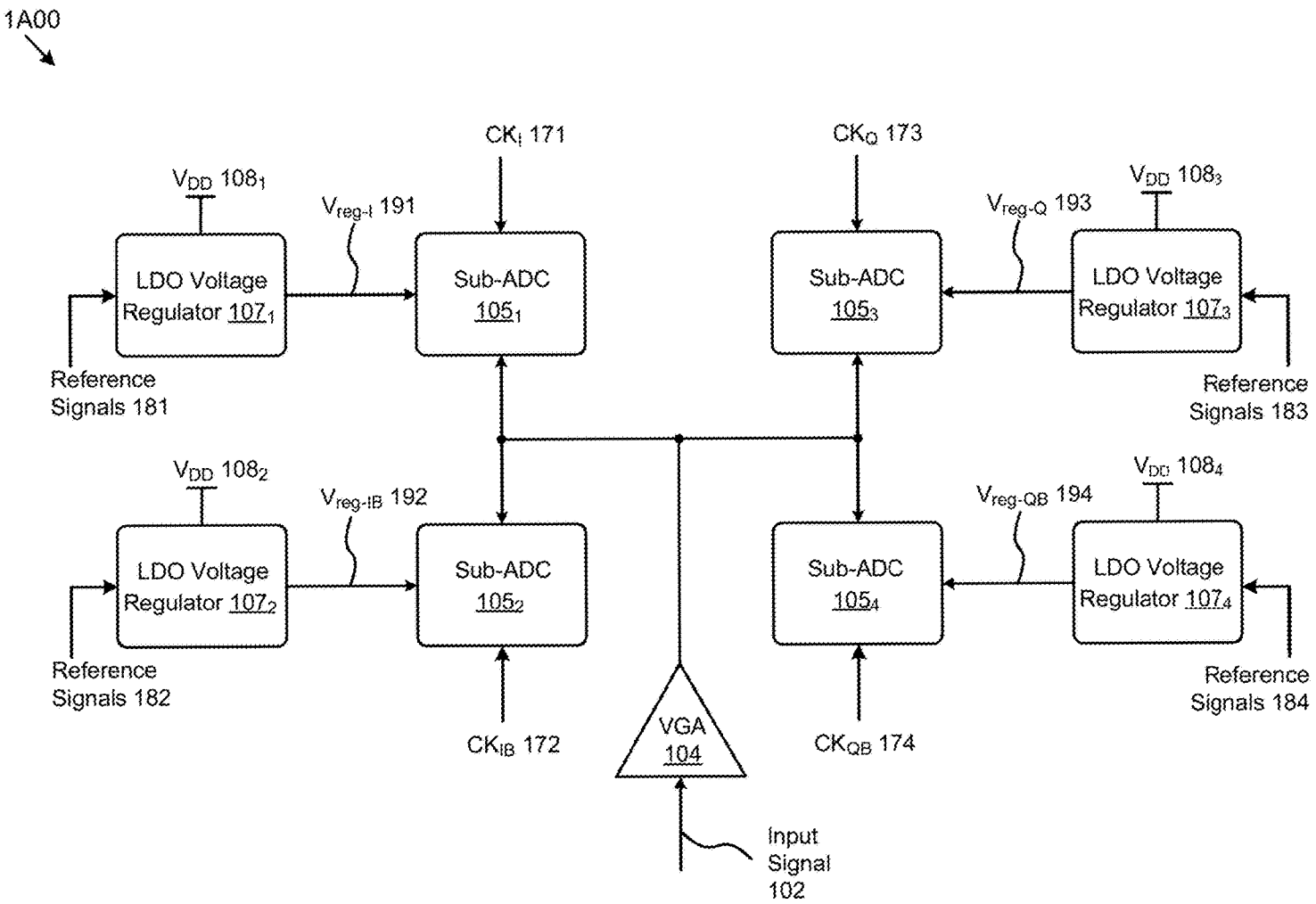
FIG. 1A is a diagram of an environment that includes low dropout voltage regulators.

Some embodiments of the present disclosure address the problem of implementing a wideband low dropout voltage regulator that exhibits high power supply rejection, and low power and low die area consumption, and some embodiments are directed to approaches for providing power supply feed-forward injection configured to offset the effects of power supply voltage variations on the voltage regulator output. More particularly, disclosed herein and in the accompanying figures are exemplary environments, methods, and systems for wideband low dropout voltage regulator with power supply rejection boost.

Overview

Voltage regulators are an increasingly more important and vital component in today's power sensitive electronic systems. Specifically, mobile systems (e.g., in smart phones, tablets, etc.) relying on a finite power source (e.g., battery) might have a dozen or more voltage regulators that provide a targeted power supply level to each subsystem such that the power consumption of the overall system is optimized. Further, high speed data communication systems (e.g., 100 Gigabit Ethernet) might also implement voltage regulators that exhibit a wide bandwidth and high power supply rejection (PSR) to not only manage power consumption, but also to block or "reject" power supply voltage variations (e.g., switching noise from one or more system switching regulators) from the data signals on the data receive channels.

More specifically, such high speed data communication systems might deploy one or more LDO voltage regulators that exhibit a high PSR performance in a frequency range of 100 kHz to 100 MHz. Legacy LDO voltage regulator designs approach a high PSR in this range by implementing a high gain and high bandwidth front end operational amplifier (e.g., error amplifier). However, this technique increases the power consumption and noise of the LDO voltage regulator. Further, such techniques require a large amount of decoupling capacitance at the LDO voltage regulator output to suppress the peak PSR, adding costly die area to the design.

Some embodiments of the present disclosure address the problem of implementing a wideband low dropout voltage regulator that exhibits high power supply rejection, and low power and low die area consumption. More specifically, the techniques disclosed herein provide a wideband LDO voltage regulator that has a voltage regulator core powered by a supply voltage and providing a regulated voltage output, and a power supply feed forward injection module delivering an injection signal to the voltage regulator core to boost the rejection of the supply voltage variation from the regulated voltage. In one or more embodiments, the injection signal is injected into the output stage of the voltage regulator core and is configured to offset the intrinsic effects of supply voltage variations on the regulated voltage. In one or more embodiments, the injection signal is determined from the supply voltage variation and a gain factor that is based on various design attributes of the output stage of the voltage regulator core. In one or more embodiments, the power supply feed forward injection module comprises a supply voltage sense circuit, a low pass filter, and one or more selectable transconductance amplifiers, and provides an injection current to the voltage regulator core.

Definitions

Some of the terms used in this description are defined below for easy reference. The presented terms and their respective definitions are not rigidly restricted to these definitions—a term may be further defined by the term's use within this disclosure.

- The term "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.
- As used in this application and the appended claims, the term "or" is intended to mean an inclusive "or" rather than an exclusive "or". That is, unless specified otherwise, or is clear from the context, "X employs A or B" is intended to mean any of the natural inclusive permutations. That is, if X employs A, X employs B, or X employs both A and B, then "X employs A or B" is satisfied under any of the foregoing instances.
- The articles "a" and "an" as used in this application and the appended claims should generally be construed to mean "one or more" unless specified otherwise or is clear from the context to be directed to a singular form.
- The term "logic" means any combination of software or hardware that is used to implement all or part of the disclosure.
- The term "non-transitory computer readable medium" refers to any medium that participates in providing instructions to a logic processor.
- A "module" includes any mix of any portions of computer memory and any extent of circuitry including circuitry embodied as a processor.

Reference is now made in detail to certain embodiments. The disclosed embodiments are not intended to be limiting of the claims.

Descriptions of Exemplary Embodiments

FIG. 1A is a diagram of an environment 1A00 that includes low dropout voltage regulators. As an option, one or more instances of environment 1A00 or any aspect thereof may be implemented in the context of the architecture and functionality of the embodiments described herein. Also, the environment 1A00 or any aspect thereof may be implemented in any desired environment.

As shown in FIG. 1A, the environment 1A00 illustrates an environment in which the herein disclosed techniques for a wideband low dropout voltage regulator with power supply rejection boost can be implemented. Specifically, the environment 1A00 represents a high speed data communications receiver. The environment 1A00 can also be representative of similar systems in a variety of environments and applications, such as optical serial data communication links, memory data interfaces, and wireless transceivers. Specifically, the environment 1A00 receives an input signal 102 at a variable gain amplifier 104 that drives amplified input signals to a plurality of Sub-ADCs 105 (e.g., Sub-ADC $\mathbf{105}_1$, Sub-ADC $\mathbf{105}_2$, Sub-ADC $\mathbf{105}_3$, and Sub-ADC $\mathbf{105}_4$). A set of input clocks related to in phase and quadrature phase timing (e.g., $CK_1$ 171, $CK_{IB}$ 172, $CK_Q$ 173, and $CK_{QB}$ 174) are delivered to the respective ones of the plurality of Sub-ADCs 105, such that each instance of the plurality of Sub-ADCs 105 generates a digital representation (e.g., 8 bits wide) of the input signal 102 sampled at timing associated with the respective set of input clocks.

As further shown in environment 1A00, the power for each instance of the plurality of Sub-ADCs 105 can be supplied by a respective instance of a plurality of LDO voltage regulators 107 (e.g., LDO voltage regulator $\mathbf{107}_1$, LDO voltage regulator $\mathbf{107}_2$, LDO voltage regulator $\mathbf{107}_3$, and LDO voltage regulator $\mathbf{107}_4$). Each instance of the plurality of LDO voltage regulators 107 is powered by a system power supply $V_{DD}$ through a respective instance of a plurality of $V_{DD}$ connections 108 (e.g., $V_{DD}$ $\mathbf{108}_1$, $V_{DD}$ $\mathbf{108}_2$, $V_{DD}$ $\mathbf{108}_3$, and $V_{DD}$ $\mathbf{108}_4$), receives a respective set of reference signals (e.g., reference signals 181, reference signals 182, reference signals 183, and reference signals 184), and produces a respective regulated voltage output (e.g., $V_{reg\text{-}I}$ 191, $V_{reg\text{-}IB}$ 192, $V_{reg\text{-}Q}$ 193, and $V_{reg\text{-}QB}$ 194). The respective sets of reference signals for each instance of the plurality LDO voltage regulators 107 can comprise a common set of signals or differing sets of signals, with the signals including system references (e.g., bandgap voltage reference), digital control signals, and other signals. In the case shown in environment 1A00, the plurality of LDO voltage regulators 107 might be configured to produce respective regulated voltage outputs that exhibit the same intrinsic characteristics (e.g., voltage level, PSR, bandwidth, etc.). In other cases and environments (e.g., mobile phone systems), multiple LDO voltage regulators might be configured to produce respective regulated voltage outputs that exhibit differing intrinsic characteristics.

Figure 1B:
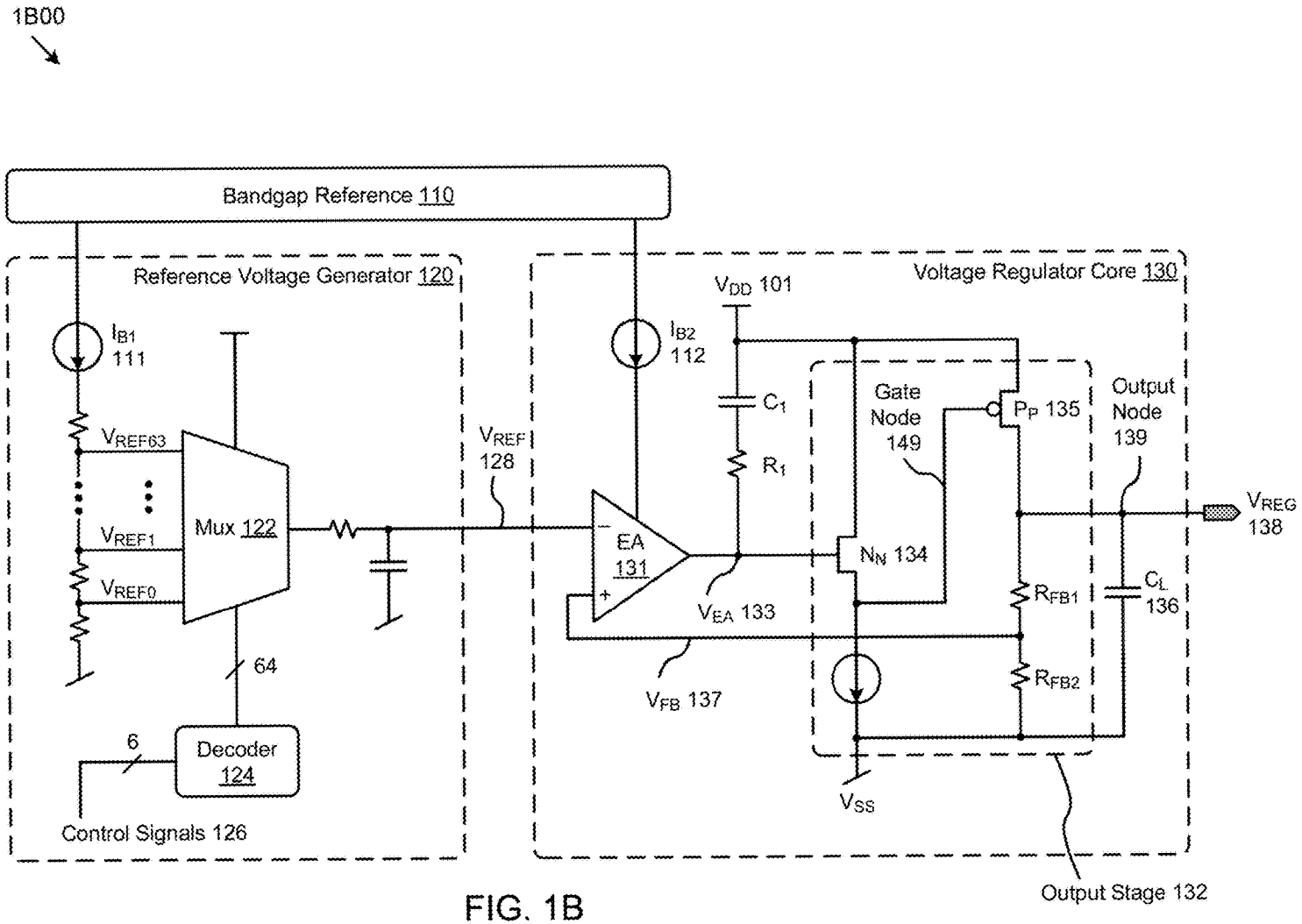
FIG. 1B is a block diagram of a low dropout voltage regulator subsystem.
Figure 1C:
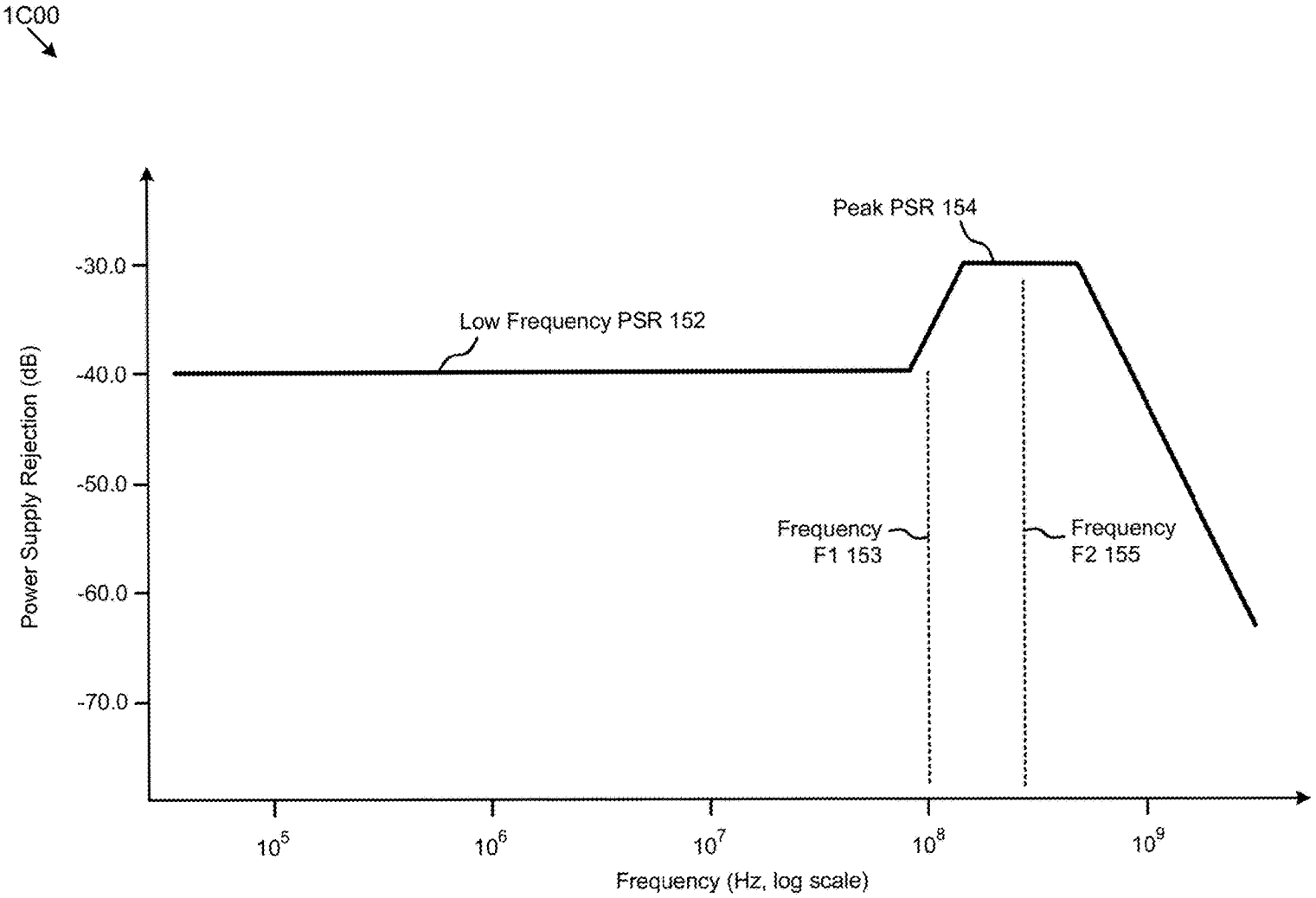
FIG. 1C depicts a waveform showing a power supply rejection characteristic of a low dropout voltage regulator.

As previously mentioned, systems such as represented by environment 1A00 might deploy LDO voltage regulators that exhibit a wide bandwidth and high power supply rejection (PSR) to not only manage power consumption, but also to reject power supply voltage variations on the external $V_{DD}$ feeding $V_{DD}$ $\mathbf{108}_1$, $V_{DD}$ $\mathbf{108}_2$, $V_{DD}$ $\mathbf{108}_3$, and $V_{DD}$ $\mathbf{108}_4$. For example, contributions to power supply voltage variations might come from the power supply, other external circuits and devices, digital switching noise, and other sources. FIGS. 1B and 1C describe a legacy approach to providing such LDO voltage regulators.

FIG. 1B is a block diagram 1B00 of a low dropout voltage regulator subsystem. As an option, one or more instances of block diagram 1B00 or any aspect thereof may be implemented in the context of the architecture and functionality of the embodiments described herein. Also, the block diagram 1B00 or any aspect thereof may be implemented in any desired environment.

As shown in FIG. 1B, the block diagram 1B00 comprises a bandgap reference 110, a reference voltage generator 120, and a voltage regulator core 130 (e.g., LDO voltage regulator), powered by a supply voltage $V_{DD}$ 101. As shown, the bandgap reference 110 is configured to provide stable bias currents (e.g., bias current $I_{B1}$ 111 and bias current $I_{B2}$ 112) to the reference voltage generator 120 and the voltage regulator core 130, respectively. The reference voltage generator 120 produces a reference voltage $V_{REF}$ 128 that is used by the voltage regulator core 130 to produce a regulated voltage $V_{REG}$ 138 at an output node 139. More specifically, the reference voltage generator 120 receives the bias current $I_{B1}$ 111 into a resistive network to generate a set of reference voltages (e.g., $V_{REF0}$, $V_{REF1}$, . . . , $V_{REF63}$). One voltage from the set of reference voltages is selected by a multiplexer 122 to pass through to the reference voltage $V_{REF}$ 128. The selection at the multiplexer 122 can be determined by a digital selection signal (e.g., 64-bit parallel code) provided by a set of control signals 126 (e.g., 6-bit binary code) and a decoder 124.

As further shown in FIG. 1B, the voltage regulator core 130 receives the reference voltage $V_{REF}$ 128 at an error amplifier 131 that produces a voltage $V_{EA}$ 133 to drive an output stage 132 that generates the regulated voltage $V_{REG}$ 138. More specifically, the voltage $V_{EA}$ 133 is received by an input device $N_N$ 134 (e.g., N-type MOSFET transistor) configured to operate as a source follower to drive a signal at a gate node 149 coupled to an output device $P_P$ 135 (e.g., P-type MOSFET transistor), which in turn drives the regulated voltage $V_{REG}$ 138. The output stage 132 further comprises a resistive network (e.g., $R_{FB1}$ and $R_{FB2}$) that senses the regulated voltage $V_{REG}$ 138 to produce a feedback voltage $V_{FB}$ 137 used by the error amplifier 131 to regulate the regulated voltage $V_{REG}$ 138 with respect to the reference voltage $V_{REF}$ 128. Also, a decoupling capacitor $C_L$ 136 is coupled to the output node 139. The decoupling capacitor $C_L$ 136 and other components included in the voltage regulator core 130 impact the PSR performance of the voltage regulator core 130 as discussed in FIG. 1C.

FIG. 1C depicts a waveform 1C00 showing a power supply rejection characteristic of a low dropout voltage regulator. As an option, one or more instances of waveform 1C00 or any aspect thereof may be implemented in the context of the architecture and functionality of the embodiments described herein. Also, the waveform 1C00 or any aspect thereof may be implemented in any desired environment.

The waveform 1C00 illustrates a power supply rejection (PSR) response over frequency of an LDO voltage regulator such as the voltage regulator core 130 in block diagram 1B00 of FIG. 1B. More specifically, the waveform 1C00 depicts a PSR in decibels (dB) over a log scale of frequency in Hertz (Hz) according to the following equation:

$$PSR=20\cdot\log(v_{reg}/v_d), \qquad \text{[EQ. 1]}$$

where:

$v_{reg}$ is the small signal variation of the regulated voltage $D_{REG}$ 138, and $v_d$ is the small signal variation of the supply voltage $V_{DD}$ 101.

According to [EQ. 1], a "high" PSR is characterized by a low PSR value (e.g., $v_{reg} \ll v_d$). Referring to waveform 1C00 and block diagram 1B00, the voltage regulator core 130 can be configured to exhibit a low frequency PSR 152 (e.g., −40 dB) up to a frequency F1 153 (e.g., 100 MHz). The frequency F1 153 represents the dominant pole of the voltage regulator core 130 which follows the bandwidth of the error amplifier 131, including the output loading of the error amplifier 131 (e.g., see $R_1$ and $C_1$ in FIG. 1B). At frequencies higher than the frequency F1 153, the PSR peaks to a peak PSR 154 (e.g., −30 dB). The decoupling capacitor $C_L$ 136 can be configured (e.g., sized) to suppress the peak PSR 154 by decreasing the PSR from a frequency F2 155 (e.g., 300 MHz) determined, in part, by the value of the decoupling capacitor $C_L$ 136. Achieving the wide bandwidth (e.g., 100 MHz) of the error amplifier 131 depicted in waveform 1C00 can result in additional power consumption and noise, which can conflict with system design constraints. As an example, if the bandwidth of the error amplifier 131 is reduced (e.g., to reduce power consumption and noise), the frequency F1 153 at which the PSR peaking starts is also reduced, and the peak PSR 154 is increased. As the peak PSR 154 is increased, the value and size of the decoupling capacitor $C_L$ 136 might also be increased to suppress the higher peak PSR 154. However, in some cases, the size of the decoupling capacitor $C_L$ 136 can be limited by design area constraints such that the achievable worst case PSR (e.g., the peak PSR 154) is also limited. Techniques are therefore needed to address the problem of implementing a wideband low dropout voltage regulator that exhibits high power supply rejection, and low power and low die area consumption. For example, such techniques can be used to implement an LDO voltage regulator that can achieve a target PSR (e.g., the PSR characteristic shown in the waveform 1C00), but with an error amplifier having a low bandwidth (e.g., 10 MHz) and a decoupling capacitor having a low value (e.g., small size). Such techniques are described, in part, in FIG. 2A and FIG. 2B.

Figure 2B:
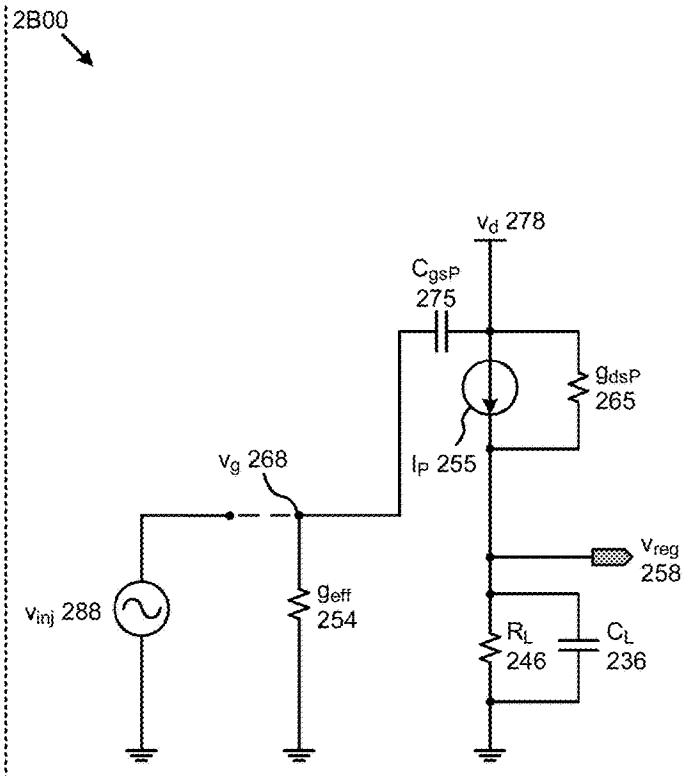
FIG. 2B is a schematic depicting a small signal representation of a low dropout voltage regulator output stage.
Figure 2A:
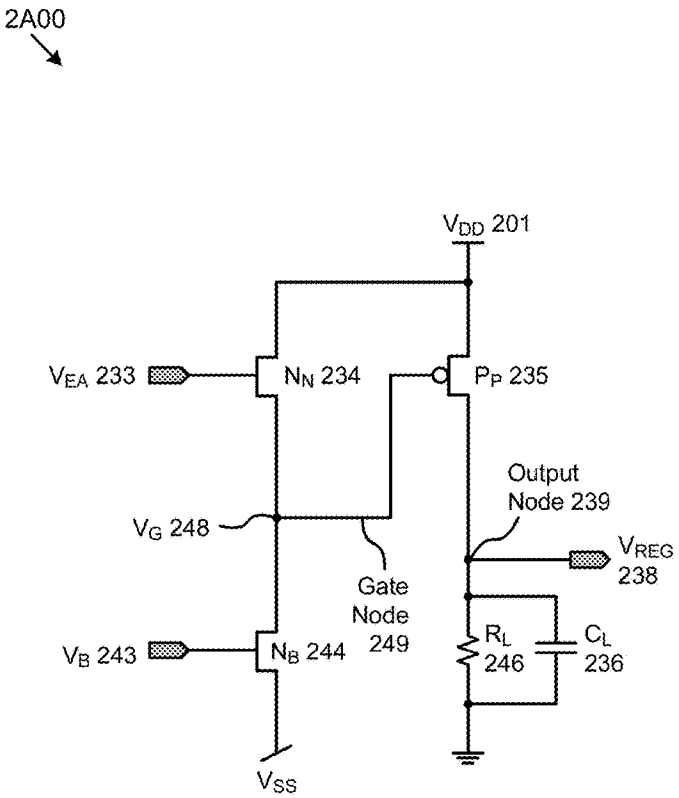
FIG. 2A is a schematic of a low dropout voltage regulator output stage.

FIG. 2A is a schematic 2A00 of a low dropout voltage regulator output stage. As an option, one or more instances of schematic 2A00 or any aspect thereof may be implemented in the context of the architecture and functionality of the embodiments described herein. Also, the schematic 2A00 or any aspect thereof may be implemented in any desired environment.

The schematic 2A00 illustrates an output stage of an LDO voltage regulator for analyzing techniques for implementing wideband low dropout voltage regulators with power supply rejection boost. Specifically, the output stage in schematic 2A00 is powered by a supply voltage $V_{DD}$ 201 and comprises an input device $N_N$ 234 (e.g., N-type MOSFET transistor) receiving a voltage $V_{EA}$ 233 (e.g., from an error amplifier such as error amplifier 131). The input device $N_N$ 234 is configured (e.g., with loading devices) to operate as a source follower and drive a gate voltage $V_G$ 248 at a gate node 249 coupled to an output device $P_P$ 235 (e.g., P-type MOSFET transistor), which in turn drives a regulated voltage $D_{REG}$ 238 at an output node 239. A bias device $N_B$ 244 (e.g., N-type MOSFET transistor) is controlled by a bias voltage $V_B$ 243 and provides a bias current to the input device $N_N$ 234. Also, a decoupling capacitor $C_L$ 236 and a load resistance $R_L$ 246 is coupled to the output node 239. A small signal representation of the output stage shown in schematic 2A00 is depicted in FIG. 2B.

FIG. 2B is a schematic 2B00 depicting a small signal representation of a low dropout voltage regulator output stage. As an option, one or more instances of schematic 2B00 or any aspect thereof may be implemented in the context of the architecture and functionality of the embodiments described herein. Also, the schematic 2B00 or any aspect thereof may be implemented in any desired environment.

At frequencies near and beyond the bandwidth of the error amplifier providing the voltage $V_{EA}$ 233 to the LDO voltage regulator output stage shown in schematic 2A00, the small signal effects at the input of the output stage (e.g., at voltage $V_{EA}$ 233) are negligible and the small signal equivalent of schematic 2A00 reduces to the circuit shown in schematic 2B00 of FIG. 2B. Specifically, a combination of the output impedance of the input device $N_N$ 234 and the output impedance of the bias device $N_B$ 244 can be represented by an effective transconductance $g_{eff}$ 254, and the output device $P_P$ 235 can be represented by a current source $I_P$ 255, a drain transconductance $g_{dsP}$ 265, and a gate to source capacitance $C_{gsP}$ 275. Further the small signal variation of the gate voltage $V_G$ 248 can be represented by a small signal gate voltage $v_g$ 268, the small signal variations of the supply voltage $V_{DD}$ 201 can be represented by a small signal supply voltage $v_d$ 278, and the small signal variations of the regulated voltage $V_{REG}$ 238 can be represented by a small signal regulated voltage $v_{reg}$ 258. Given the small signal representation in schematic 2B00, the regulated voltage variation due to supply voltage variation (e.g., $v_{reg}=f(v_d)$) can be represented as follows:

$$v_{reg}=v_d\cdot[(g_{mP}\cdot g_{eff})/(C_{gsP}+g_{eff})+g_{dsP}]/[C_L+G_L+g_{dsP}] \quad \text{[EQ. 2]}$$

where:

$g_{mP}=I_P(v_d-v_g)$ and is the transconductance of output device $P_P$ 235, and $G_L=1/R_L$.

As shown in schematic 2B00, introducing an injected voltage $v_{inj}$ 288 to drive the small signal gate voltage $v_g$ 268 can produce an effect that modifies the response of the small signal regulated voltage $v_{reg}$ 258 to variations in the small signal supply voltage $v_d$ 278. Specifically, in accordance with [EQ. 2], the injected voltage $v_{inj}$ 288 can cause the small signal regulated voltage $v_{reg}$ 258 to have no response to variations (e.g., noise) in the small signal supply voltage $v_d$ 278 (e.g., $v_{reg}/v_d=0$) when, $$v_{inj}=V_g=v_d\cdot[1+(g_{dsP}/g_{mP})]. \quad \text{[EQ. 3]}$$

Given the definition of PSR in [EQ. 1], and having the injected voltage $v_{inj}$ 288 and the small signal gate voltage $v_g$ 268 set to the value indicated in [EQ. 3], an LDO voltage regulator including an output stage as depicted in schematic 2A00 and schematic 2B00 can have an intrinsic PSR that approaches negative infinity. The injected voltage $v_{inj}$ 288 according to [EQ. 3] provides a signal at the gate node 249 coupled to the output device $P_P$ 235 that is equal to the supply voltage variation (e.g., $v_d$) plus the supply voltage variation multiplied by a scale factor $g_{dsP}/g_{mP}$, where the scale factor $g_{dsP}/g_{mP}$ is determined by various device design attributes of the output device $P_P$ 235. More specifically, the scale factor $g_{dsP}/g_{mP}$ is the inverse of the intrinsic gain of the output device $P_P$ 235. The injected voltage $v_{inj}$ 288 effectively "feeds forward" a scaled version of the supply voltage variation to the gate node 249 of the output device $P_P$ 235 to "boost" the PSR (e.g., reduce the PSR value in dB) by offsetting the intrinsic effects of supply voltage variations on the regulated voltage. An implementation of such a feed-forward injection technique is described in FIG. 3.

Figure 3:
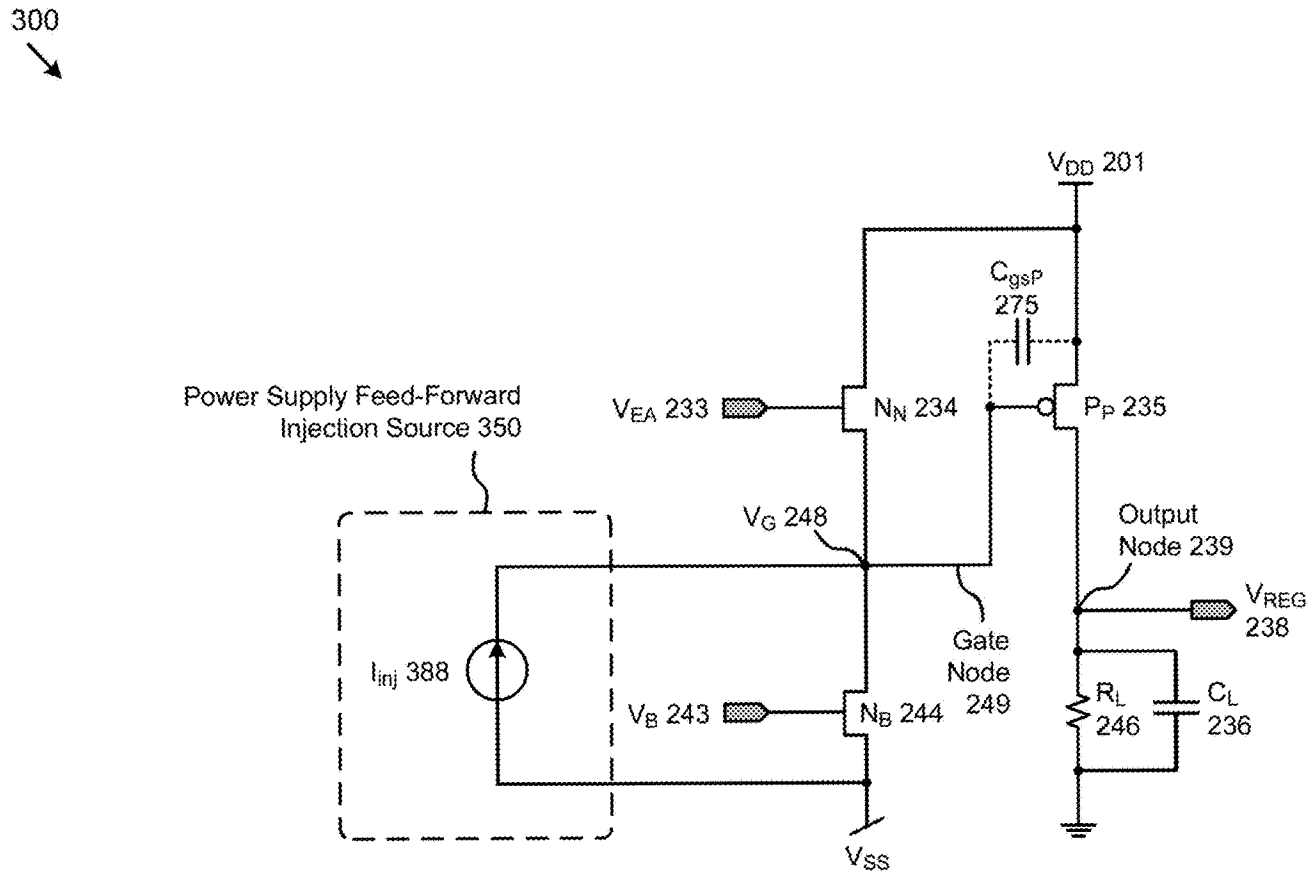
FIG. 3 is a schematic of a power supply feed-forward injection technique as used to implement a wideband low dropout voltage regulator with power supply rejection boost, according to an embodiment.

FIG. 3 is a schematic 300 of a power supply feed-forward injection technique as used to implement a wideband low dropout voltage regulator with power supply rejection boost. As an option, one or more instances of schematic 300 or any aspect thereof may be implemented in the context of the architecture and functionality of the embodiments described herein. Also, the schematic 300 or any aspect thereof may be implemented in any desired environment.

As shown in FIG. 3, the schematic 300 comprises the LDO voltage regulator output stage of FIG. 2A coupled to a power supply feed-forward injection source 350. As shown, in one or more embodiments, an injected current $I_{inj}$ 388 can be used to deliver a scaled version of the supply voltage variation to the gate node 249 coupled to the output device $P_P$ 235 to boost the PSR of the output stage and the overall LDO voltage regulator. In accordance with [EQ. 3], the value of the injected current $I_{inj}$ 388 used to offset the intrinsic effects of supply voltage variations on the regulated voltage is given by:

$$I_{inj}=v_d\cdot G_{inj} \quad \text{[EQ. 4]}$$

Where:

$G_{inj}=g_{mN}\cdot[1+(g_{dsP}/g_{mP})]$, and $g_{mN}$ is the transconductance of input device $N_N$ 234.

The target gain factor $G_{inj}$ can be determined, in part, by the device design attributes of the input device $N_N$ 234 and the output device $P_P$ 235 according to [EQ. 4]. More specifically, the gain factor can be determined by the transconductance of input device $N_N$ 234 (e.g., $g_{mN}$), and the transconductance and drain transconductance of output device $P_P$ 235 (e.g., $g_{mP}$ and $g_{dsP}$, respectively). Assuming the drain transconductance of the bias device $N_B$ 244 (e.g., $g_{dsB}$) is negligible compared to $g_{mN}$, the small signal gate voltage $v_g$ generated by the injected current $I_{inj}$ 388 is:

$$\begin{aligned} v_g &= I_{inj} / g_{mN} \\ &= v_d \cdot G_{inj} / g_{mN} \\ &= v_d \cdot [1 + (g_{dsP} / g_{mP})]. \end{aligned} \quad \text{[EQ. 5]}$$

As shown, [EQ. 5] is in agreement with [EQ. 3] such that the injected current $I_{inj}$ 388 as defined by [EQ. 4] will generate a small signal gate voltage $v_g$ at the gate node 249 coupled to the output device $P_P$ 235 that can offset the intrinsic effects of supply voltage variations on the regulated voltage. At high frequencies, the gate to source capacitance $C_{gsP}$ 275 of output device $P_P$ 235 (e.g., see schematic 300) can impact the effectiveness of the injected current $I_{inj}$ 388 such that the relationship of the high frequency small signal gate voltage $v_g'$ to the high frequency small signal supply voltage $v_d'$ can be represented by:

$$v_g' = v_d' \cdot (C_{gsP}/G_{inj})/(C_{gsP}+g_{mN}) \quad \text{[EQ. 6]}$$

Figure 4:
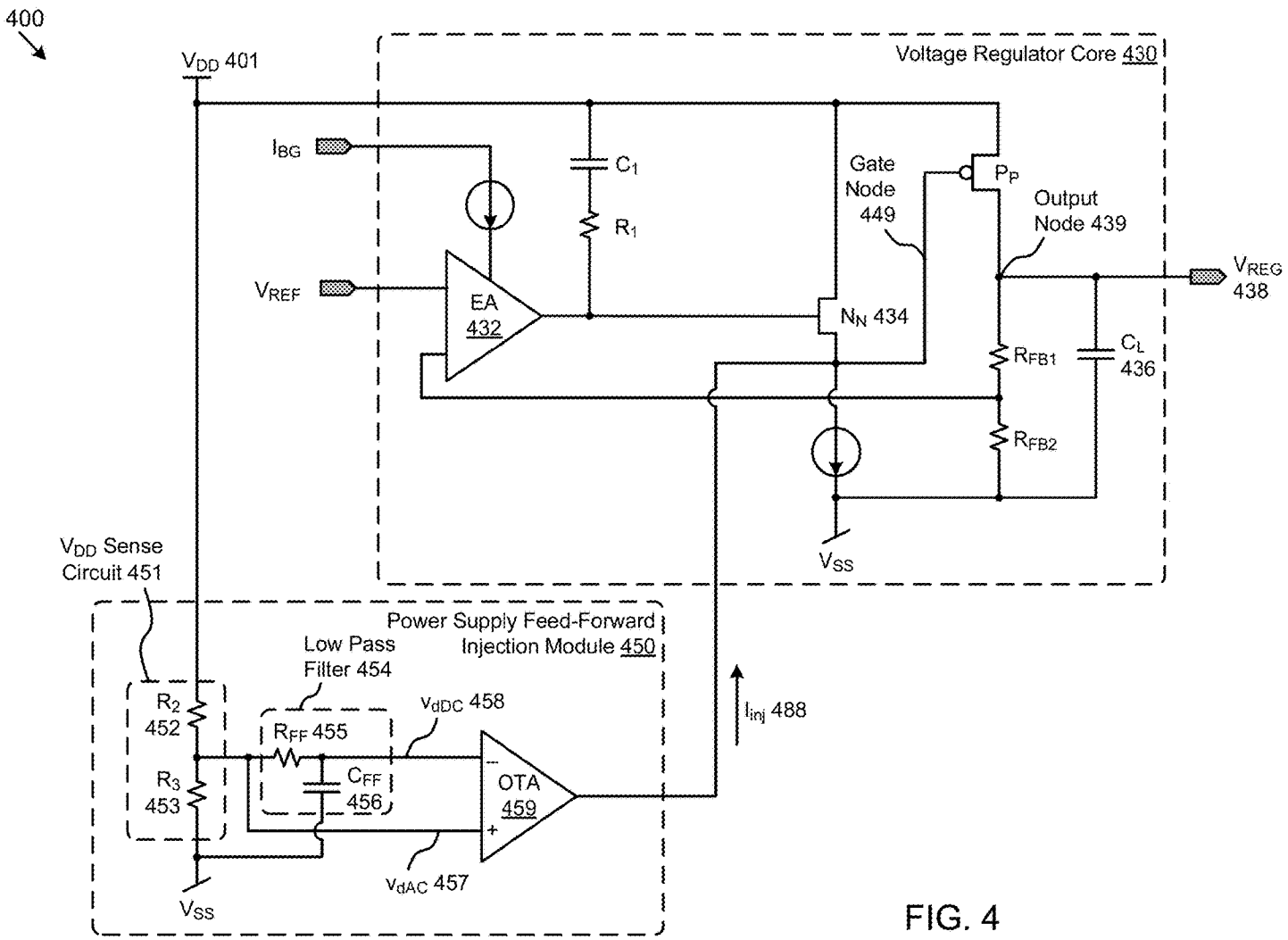
FIG. 4 is a block diagram of a power supply feed-forward injection implementation of a wideband low dropout voltage regulator with power supply rejection boost, according to an embodiment.

FIG. 4 describes an implementation of the power supply feed-forward injection source 350 according to some embodiments.

FIG. 4 is a block diagram 400 of a power supply feed-forward injection implementation of a wideband low dropout voltage regulator with power supply rejection boost. As an option, one or more instances of block diagram 400 or any aspect thereof may be implemented in the context of the architecture and functionality of the embodiments described herein. Also, the block diagram 400 or any aspect thereof may be implemented in any desired environment.

As shown in FIG. 4, the block diagram 400 comprises a power supply feed-forward injection module 450 coupled to a voltage regulator core 430 to provide an injection current $I_{inj}$ 488 to a gate node 449 of the voltage regulator core 430. The injection current $I_{inj}$ 488 is configured (e.g., according to [EQ. 4]) to offset the intrinsic effects of supply voltage (e.g., supply voltage $V_{DD}$ 401) variations on the regulated voltage (e.g., $V_{REG}$ 438) to boost the PSR of the voltage regulator core 430. More specifically, the power supply feed-forward injection module 450 comprises a $V_{DD}$ sense circuit 451, a low pass filter 454, and an operational transconductance amplifier, such as OTA 459. The $V_{DD}$ sense circuit 451 further comprises a resistor $R_2$ 452 and a resistor $R_3$ 453 coupled in series to provide a scaled supply voltage (e.g., see voltage $v_{dAc}$ 457) to the low pass filter 454 and the non-inverting terminal of the OTA 459 (e.g., see "+" terminal). The low pass filter 454 is comprised of a resistor $R_{FF}$ 455 and a capacitor $C_{FF}$ 456 and filters the scaled supply voltage $V_{dAc}$ 457 to provide a filtered supply voltage (e.g., see voltage $V_{dDc}$ 458) to the inverting terminal of the OTA 459 (e.g., see "−" terminal). Various circuit design attributes, such as the ratio $R_2/(R_2+R_3)$ and the input transconductance of the OTA 459, can be used to generate a gain factor that aligns to the target gain factor $G_{inj}$ (e.g., see [EQ. 4]) such that the injection current $I_{inj}$ 488 is effective in offsetting the intrinsic effects of supply voltage variations on the regulated voltage and boosting the PSR of the voltage regulator core 430. More specifically, the input stage or stages of the OTA 459 can comprise devices of the same type (e.g., N-type MOSFET) as the input device $N_N$ 434 of the voltage regulator core 430 such that the gain factor generated by the power supply feed-forward injection module 450 tracks the target gain factor $G_{inj}$ over process, voltage, and temperature variations as one or more device design attributes (e.g., of the OTA 459 and the input device $N_N$ 434) also track. The PSR response resulting from the PSR boost technique provided by the power supply feed-forward injection module 450 is illustrated in FIG. 5.

Figure 5:
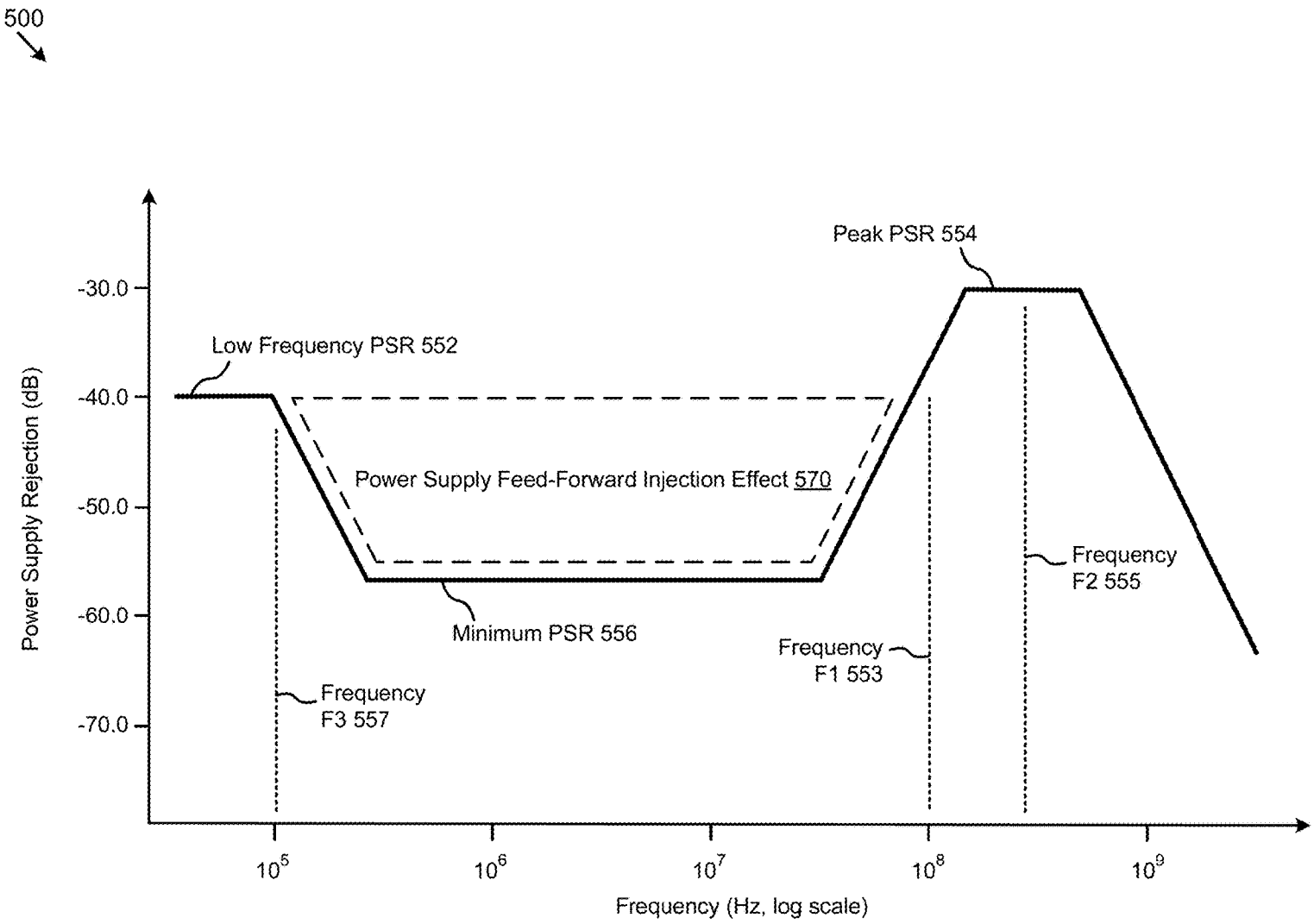
FIG. 5 depicts a waveform showing a power supply rejection characteristic of a wideband low dropout voltage regulator with power supply rejection boost, according to an embodiment.

FIG. 5 depicts a waveform 500 showing a power supply rejection characteristic of a wideband low dropout voltage regulator with power supply rejection boost. As an option, one or more instances of waveform 500 or any aspect thereof may be implemented in the context of the architecture and functionality of the embodiments described herein. Also, the waveform 500 or any aspect thereof may be implemented in any desired environment.

The waveform 500 illustrates a PSR response over frequency of a wideband LDO voltage regulator with power supply rejection boost such as described in FIG. 4. More specifically, and referring to block diagram 400, the waveform 500 depicts a PSR in decibels (dB) over a log scale of frequency in Hertz (Hz) according to [EQ. 1], where $v_{reg}$ is the small signal variation of the regulated voltage $V_{REG}$ 438 and $v_d$ is the small signal variation of the supply voltage $V_{DD}$ 401. Referring also to waveform 1C00 for comparison, the voltage regulator core 430 and the power supply feed-forward injection module 450 can be configured to exhibit a low frequency PSR 552 (e.g., −40 dB) that corresponds to the low frequency PSR 152 in waveform 1C00. Further, a peak PSR 554 (e.g., −30 dB), a frequency F1 553 (e.g., 100 MHz), and a frequency F2 555 (e.g., 300 MHz) of waveform 500 also correspond to the peak PSR 154, the frequency F1 153, and the frequency F2 155, respectively, of waveform 1C00.

As shown in FIG. 5, waveform 500 further exhibits a decrease in PSR value at a frequency F3 557 (e.g., 100 kHz) to a minimum PSR 556 (e.g., <−55 dB), and then an increase in PSR value as the frequency approaches the frequency F1 553. This additional characteristic of the PSR response shown in waveform 500 can be characterized as a power supply feed-forward injection effect 570. For example, the power supply feed-forward injection effect 570 can be generated by the power supply feed-forward injection module 450 in block diagram 400. In this case, the frequency F3 557 can be represented by:

$$F3 = 1/(2\pi \cdot R_{FF} \cdot C_{FF}) \quad \text{[EQ. 7]}$$

The power supply feed-forward injection effect 570 generated by the power supply feed-forward injection module 450 provides several benefits. Specifically, the power supply feed-forward injection effect 570 enables an LDO voltage regulator to include an error amplifier (e.g., EA 432) that exhibits a low bandwidth (e.g., 10 MHz), such that power consumption can be reduced while a wideband PSR characteristic is maintained (e.g., as shown in waveform 500). More specifically, referring to the power supply feed-forward injection module 450 in block diagram 400, the values of resistor $R_{FF}$ 455 and capacity $C_{FF}$ 456, the values of resistor $R_2$ 452 and resistor $R_3$ 453, and the input transconductance of the OTA 459, can be used to configure the shape and location of the power supply feed-forward injection effect 570 and the resulting PSR characteristic. For example, the frequency F3 557 can be adjusted according to [EQ. 7] based on the values of resistor $R_{FF}$ 455 and capacity $C_{FF}$ 456. As another example, the ratio $R_2/(R_2+R_3)$ and the input transconductance of the OTA 459 can be used to adjust the injection current $I_{inj}$ 488 to effect the minimum PSR 556. The value of the frequency F3 557 and the value of the minimum PSR 556 can in turn impact (e.g., suppress) the value of the peak PSR 554, such that the value and die area consumption of the decoupling capacitor $C_L$ 436 at the output node 439 of the voltage regulator core 430 can be reduced. The configurability of the power supply feed-forward injection module 450 also allows the PSR boost provided by the power supply feed-forward injection module 450 to be aligned to sensitive frequency bands that might be present in the system comprising the LDO voltage regulator.

Figure 6:
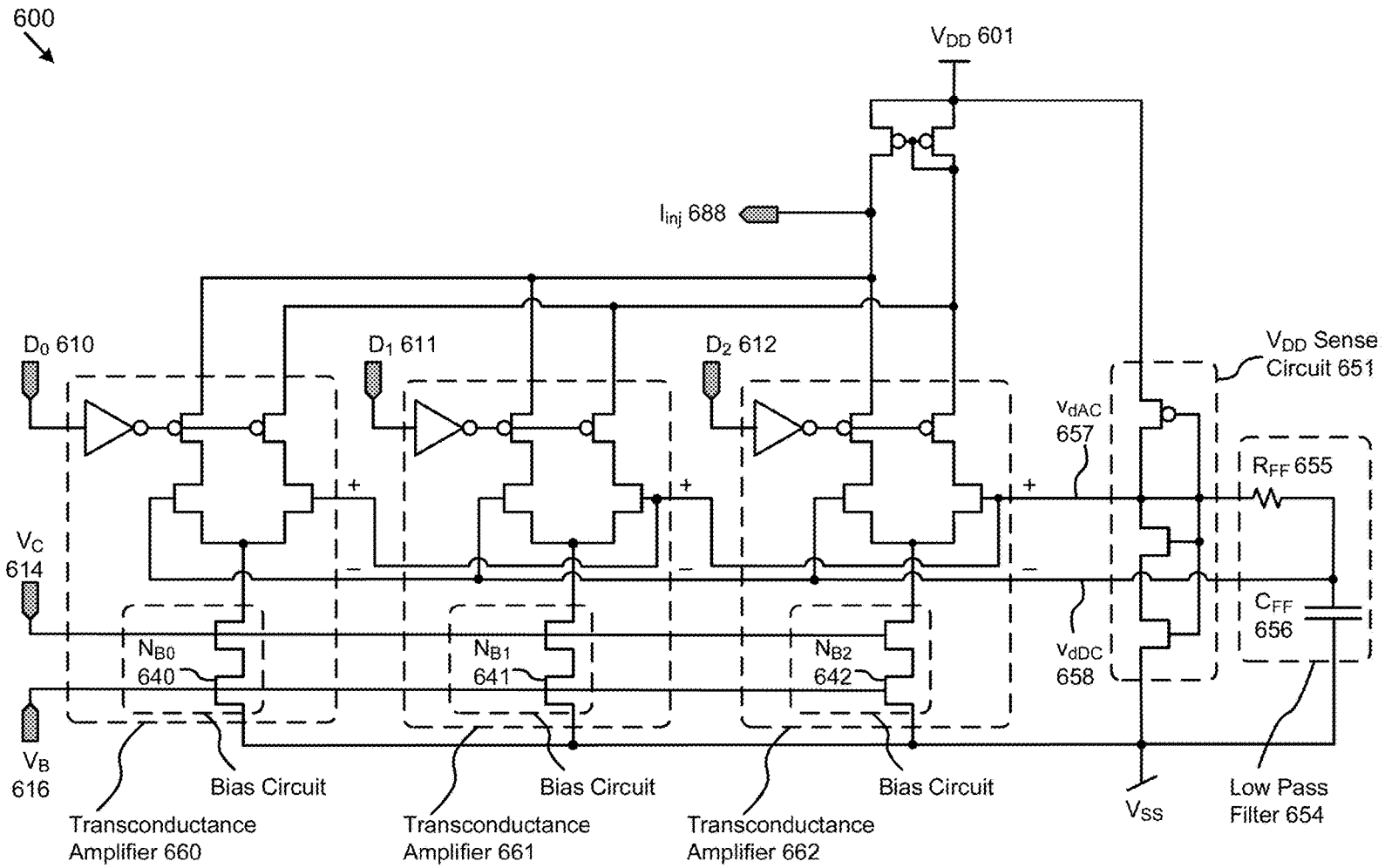
FIG. 6 is a schematic of a power supply feed-forward injection circuit as used in a wideband low dropout voltage regulator with power supply rejection boost, according to an embodiment.
Figure 7:
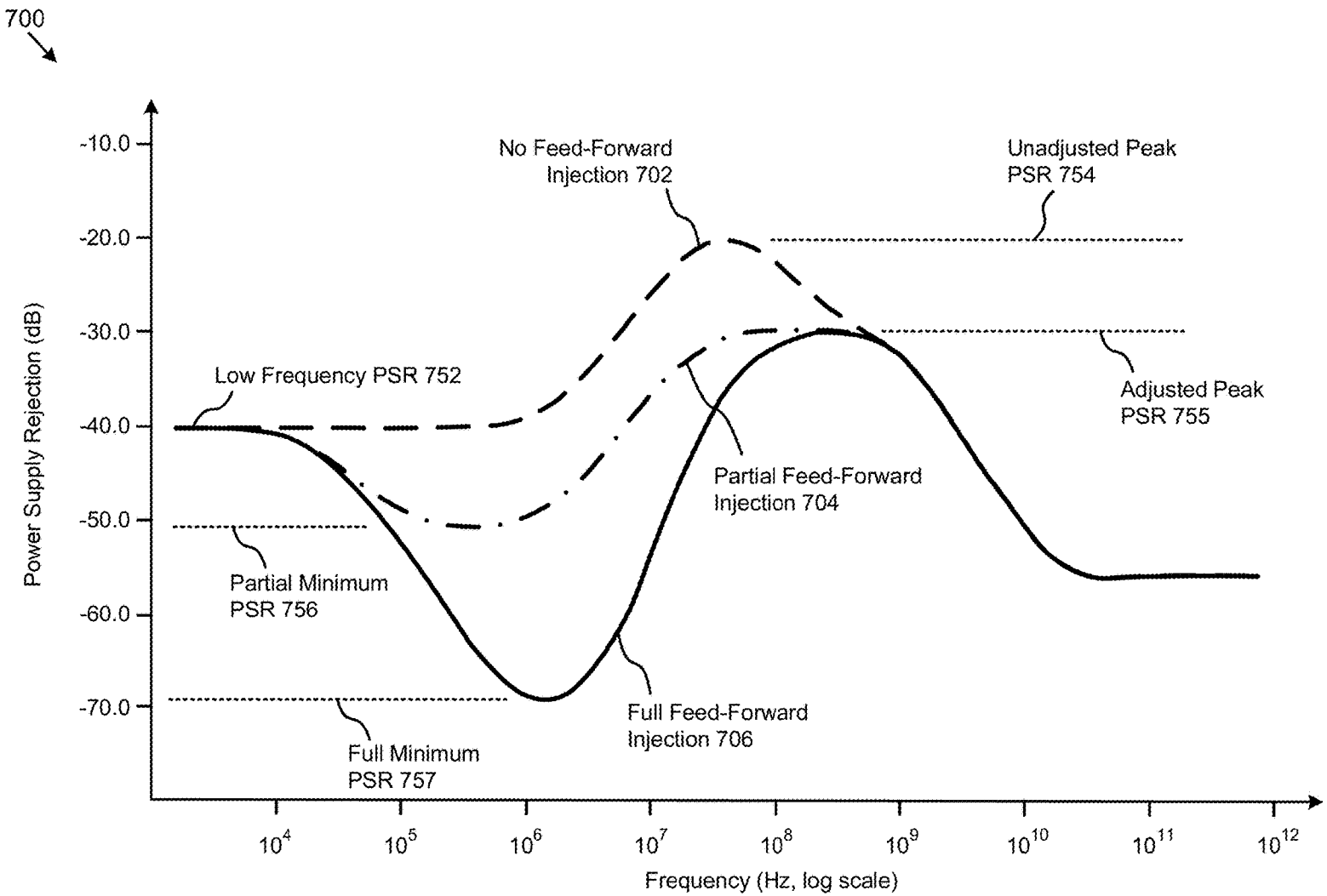
FIG. 7 presents selected waveforms showing responses to power supply feed-forward injection techniques as used in a wideband low dropout voltage regulator with power supply rejection boost, according to some embodiments.

A circuit implementation of the power supply feed-forward injection module 450 and a set of simulated PSR responses of a wideband LDO voltage regulator using the circuit implementation are described in FIG. 6 and FIG. 7, respectively.

FIG. 6 is a schematic 600 of a power supply feed-forward injection circuit as used in a wideband low dropout voltage regulator with power supply rejection boost. As an option, one or more instances of schematic 600 or any aspect thereof may be implemented in the context of the architecture and functionality of the embodiments described herein. Also, the schematic 600 or any aspect thereof may be implemented in any desired environment.

In one or more embodiments, the circuit shown in schematic 600 can provide a power supply feed-forward injection current (e.g., injection current $I_{inj}$ 688) to a voltage regulator core (e.g., voltage regulator core 430) to implement a wideband low dropout voltage regulator with power supply rejection boost. More specifically, schematic 600 comprises a $V_{DD}$ sense circuit 651, a low pass filter 654, and a plurality of transconductance amplifiers (e.g., transconductance amplifier 660, transconductance amplifier 661, and transconductance amplifier 662). The $V_{DD}$ sense circuit 651 further comprises a series of devices (e.g., N-type MOSFETs, P-type MOSFETs) coupled in a cascode configuration to provide a scaled version of a supply voltage $V_{DD}$ 601 (e.g., see scaled voltage $v_{dAC}$ 657) to the low pass filter 654 and the non-inverting terminals of the transconductance amplifiers (e.g., see "+" terminal of transconductance amplifier 660, transconductance amplifier 661, and transconductance amplifier 662). The low pass filter 654 is comprised of a resistor $R_{FF}$ 655 and a capacitor $C_{FF}$ 656 and filters the scaled voltage $v_{dAc}$ 657 to provide a filtered voltage $v_{dDc}$ 658 to the inverting terminals of the transconductance amplifiers (e.g., see "−" terminal of transconductance amplifier 660, transconductance amplifier 661, and transconductance amplifier 662). The outputs of the transconductance amplifiers are coupled in parallel such that the injection current $I_{inj}$ 688 is the sum of the current generated by the respective transconductance amplifiers. More specifically, the transconductance amplifiers provide a respective portion of the injection current $I_{inj}$ 688. Further, transconductance amplifier 660, transconductance amplifier 661, and transconductance amplifier 662 can be enabled and disabled (e.g., respective portion of current is 0 A) using a control signal $D_0$ 610, a control signal $D_1$ 611, and a control signal $D_2$ 612, respectively.

Circuit design attributes of the circuit shown in schematic 600, such as the relative value of the respective resistances across the devices comprising the $V_{DD}$ sense circuit 651 and the effective input transconductance of the transconductance amplifiers, can be used to adjust the injection current $I_{inj}$ 688 (e.g., according to [EQ. 4]) so as to offset the intrinsic effects of supply voltage variations on the regulated voltage and boost the PSR of the voltage regulator core of a wideband low dropout voltage regulator. For example, a simulated model of the circuit of schematic 600 can be used to simulate the injection current $I_{inj}$ 688 expected from the circuit, and the effect of the injection current $I_{inj}$ 688 on a voltage regulator core. The magnitude of the injection current $I_{inj}$ 688 can further be adjusted by a bias voltage $V_c$ 614, a bias voltage $V_B$ 616, and a plurality of bias devices (e.g., bias device $N_{B0}$ 640, bias device $N_{B1}$ 641, and bias device $N_{B2}$ 642). For example, the relative size (e.g., 1:2:4) of the bias devices (e.g., bias device $N_{B0}$ 640, bias device $N_{B1}$ 641, and bias device $N_{B2}$ 642, respectively) can be configured to provide a respective bias current (e.g., 160 μA, 320 μA, and 640 μA, respectively) to the respective transconductance amplifiers, such that multiple current adjustment settings can be achieved using the possible combinations (e.g., $2^3=8$) of control signal $D_0$ 610, control signal $D_1$ 611, and control signal $D_2$ 612.

Various simulated PSR responses of a wideband LDO voltage regulator using various configurations and settings of the circuit implementation of schematic 600 are described FIG. 7.

FIG. 7 presents selected waveforms 700 showing responses to power supply feed-forward injection techniques as used in a wideband low dropout voltage regulator with power supply rejection boost. As an option, one or more instances of selected waveforms 700 or any aspect thereof may be implemented in the context of the architecture and functionality of the embodiments described herein. Also, the selected waveforms 700 or any aspect thereof may be implemented in any desired environment.

As shown in FIG. 7, the selected waveforms 700 illustrate the PSR response of a wideband LDO voltage regulator to varying amounts of power supply feed-forward injection to provide PSR boost. More specifically, and referring to block diagram 400, the waveform 500 depicts a PSR in decibels (dB) over a log scale of frequency in Hertz (Hz) according to [EQ. 1], where $v_{reg}$ is the small signal variation of the regulated voltage $V_{REG}$ 438 and $v_d$ is the small signal variation of supply voltage $V_{DD}$.

For example, the selected waveforms 700 can represent the PSR as measured at the regulated voltage $V_{REG}$ 438 of the voltage regulator core 430 for various values of the injection current $I_{inj}$ 488 generated by the power supply feed-forward injection module 450 (e.g., see FIG. 4), where the power supply feed-forward injection module 450 is implemented as shown in schematic 600 (e.g., see FIG. 6). More specifically, the selected waveforms 700 depict varying PSR responses in decibels (dB) over a log scale of frequency in Hertz (Hz) according to [EQ. 1], where $v_{reg}$ is the small signal variation of the regulated voltage output of the LDO voltage regulator (e.g., regulated voltage $V_{REG}$ 438) and $v_d$ is the small signal variation of the supply voltage (e.g., supply voltage $V_{DD}$ 401). The selected waveforms 700 include the PSR response of the LDO voltage regulator when the injection current (e.g., injection current $I_{inj}$ 688) is set to 0 or PSR boost is disabled (e.g., control signal $D_0$ 610=0, control signal $D_1$ 611=0, and control signal $D_2$ 612=0), as shown in a no feed-forward injection waveform 702. The PSR response depicted in the no feed-forward injection waveform 702 begins at a low frequency PSR 752 (e.g., −40 dB) and rises to an unadjusted peak PSR 754 (e.g., −20 dB) before decreasing at higher frequencies due to the decoupling capacitance (e.g., decoupling capacitor $C_L$ 436) at the LDO voltage regulator output (e.g., output node 439). For example, the PSR response depicted in the no feed-forward injection waveform 702 can represent the PSR response of a voltage regulator core having an error amplifier (e.g., error amplifier 432) with a bandwidth of approximately 10 MHz.

The selected waveforms 700 further include the PSR response of the LDO voltage regulator when the injection current (e.g., injection current $I_{inj}$ 688) is set to an intermediate PSR boost level (e.g., control signal $D_0$ 610=1, control signal $D_1$ 611=1, and control signal $D_2$ 612=0), as shown in a partial feed-forward injection waveform 704. The PSR response depicted in the partial feed-forward injection waveform 704 begins at the low frequency PSR 752 and decreases to a partial minimum PSR 756 (e.g., −50 dB) before rising to an adjusted peak PSR 755 (e.g., −30 dB) and then decreasing at higher frequencies. The selected waveforms 700 further include the PSR response of the LDO voltage regulator when the injection current is set to a full PSR boost level (e.g., control signal $D_0$ 610=1, control signal $D_1$ 611=1, and control signal $D_2$ 612=1), as shown in a full feed-forward injection waveform 706. For example, the injection current to deliver the full PSR boost level can be as shown in [EQ. 4]. The PSR response depicted in the full feed-forward injection waveform 706 begins at the low frequency PSR 752 and decreases to a full minimum PSR 757 (e.g., −70 dB) before rising to the adjusted peak PSR 755 and then decreasing at higher frequencies. As shown, the amount of power supply feed-forward injection can effect several attributes of the PSR response. For example, as the amount of power supply feed-forward injection is increased, the peak PSR can decrease, the frequency band over which the PSR response is near the peak PSR can shift and decrease, the minimum PSR can decrease, and the frequency band over which the PSR response is near the minimum PSR can shift and decrease. Such responses to and other characteristics of the herein disclosed techniques for power supply feed-forward injection enable the implementation of voltage regulators having wide bandwidth (e.g., as shown in selected waveforms 700), low power (e.g., by enabling low bandwidth error amplifiers), low die area and cost (e.g., by enabling low decoupling capacitance), selectable PSR boost frequency bands (e.g., by adjusting the injection current), and other attributes.

Additional Embodiments of the Disclosure

Figure 8:
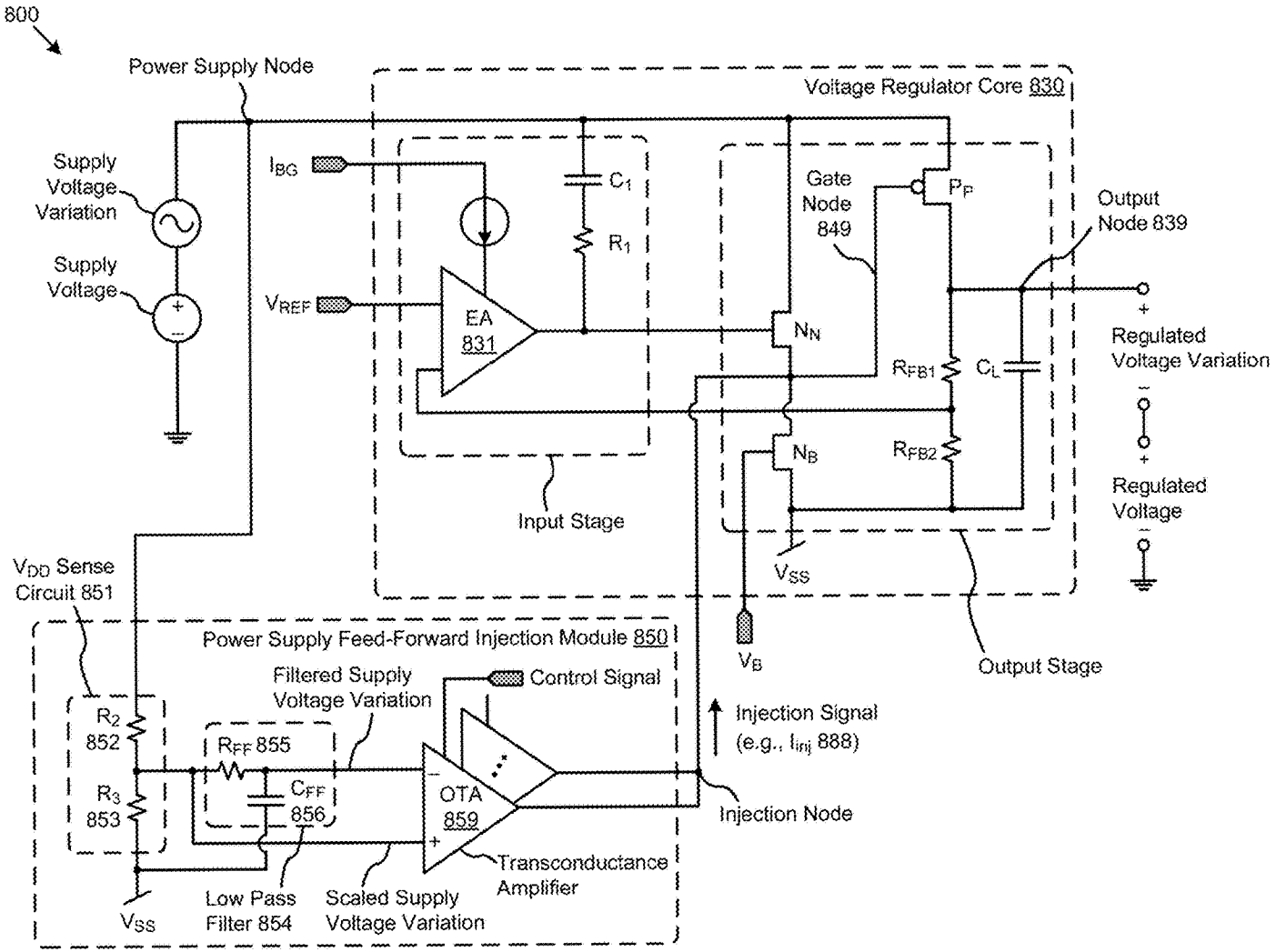
FIG. 8 is a block diagram of a wideband low dropout voltage regulator with power supply rejection boost, according to an embodiment.

FIG. 8 is a block diagram 800 of a wideband low dropout voltage regulator with power supply rejection boost. As an option, one or more instances of block diagram 800 or any aspect thereof may be implemented in the context of the architecture and functionality of the embodiments described herein. Also, the block diagram 800 or any aspect thereof may be implemented in any desired environment.

Shown in block diagram 800 is a voltage regulator comprising: a power supply node; an output node (e.g., output node 839); an injection node (e.g., gate node 849); a supply voltage and a supply voltage variation at the power supply node; a regulated voltage and regulated voltage variation at the output node; a voltage regulator core (e.g., voltage regulator core 830) coupled to the power supply node, the output node, and the injection node; and a power supply feed forward injection module (e.g., power supply feed-forward injection module 850) coupled to the power supply node and the injection node; wherein the power supply feed forward injection module generates an injection signal (e.g., injection current $I_{inj}$ 888) at the injection node to effect a power supply rejection of the supply voltage variation from the regulated voltage variation.

In one or more embodiments, as further shown in block diagram 800, the power supply feed forward injection module comprises: a sense circuit (e.g., $V_{DD}$ sense circuit 851); a low pass filter (e.g., low pass filter 854); and one or more transconductance amplifiers (e.g., OTA 859); wherein the sense circuit, the low pass filter, and the one or more transconductance amplifiers have a respective plurality of circuit design attributes; and wherein the sense circuit is coupled to the power supply node, the low pass filter, and the one or more transconductance amplifiers, and senses the supply voltage variation to provide a scaled supply voltage variation to the low pass filter and the one or more transconductance amplifiers; and wherein the low pass filter is coupled to the sense circuit and the one or more transconductance amplifiers, and receives the scaled supply voltage variation to provide a filtered supply voltage variation to the one or more transconductance amplifiers; and wherein the one or more transconductance amplifiers are coupled to the injection node, and receive the scaled supply voltage variation and the filtered supply voltage variation to provide a respective portion of an injection current to the injection node.

It should be noted that there are alternative ways of implementing the embodiments disclosed herein. Accordingly, the embodiments and examples presented herein are to be considered as illustrative and not restrictive, and the claims are not to be limited to the details given herein, but may be modified within the scope and equivalents thereof.

In the foregoing specification, the disclosure has been described with reference to specific embodiments thereof. It will, however, be evident that various modifications and changes may be made thereto without departing from the broader spirit and scope of the disclosure. For example, the above-described process flows are described with reference to a particular ordering of process actions. However, the ordering of many of the described process actions may be changed without affecting the scope or operation of the disclosure. The specification and drawings are, accordingly, to be regarded in an illustrative sense rather than in a restrictive sense.

What is claimed is:

1. A communication system comprising:

a data communications receiver having a power supply node;

a voltage regulator core coupled to the power supply node, the voltage regulator core having an output node, and an injection node; and a power supply feed forward injection module coupled to the power supply node and the injection node, the power supply feed forward injection module comprising, a sense circuit;

a low pass filter; and one or more transconductance amplifiers, wherein the sense circuit, the low pass filter, and the one or more transconductance amplifiers serve to generate an injection signal at the injection node to reject supply voltage variations.

2. The communication system of claim 1 wherein the data communications receiver implements Gigabit Ethernet.

3. The voltage regulator core of claim 1, wherein the sense circuit provides a scaled version of the supply voltage.

4. The communication system of claim 1, wherein at least one of the one or more transconductance amplifiers comprises a control signal, and wherein a state of the control signal determines at least in part, a respective portion of an injection current provided by the at least one of the one or more transconductance amplifiers.

5. The communication system of claim 4 wherein at least two of the transconductance amplifiers are coupled in parallel.

6. The voltage regulator core of claim 3, wherein the scaled version of the supply voltage provided by the sense circuit is electrically connected to the low pass filter.

7. The communication system of claim 1, wherein at least one of the one or more transconductance amplifiers comprises a bias device, wherein the bias device determines, at least in part, a respective portion of an injection current provided by the at least one of the one or more transconductance amplifiers.

8. A voltage regulator having a supply voltage, a power supply node to produce a regulated voltage at an output node, and an injection node for controlling power supply voltage variations, the voltage regulator comprising:

a voltage regulator core coupled to the power supply node, the output node, and the injection node; and a power supply feed forward injection module coupled to the power supply node and the injection node, the power supply feed forward injection module comprising, a sense circuit;

a low pass filter; and one or more transconductance amplifiers, wherein the sense circuit, the low pass filter, and the one or more transconductance amplifiers serve to generate an injection signal at the injection node to reject supply voltage variations.

9. The voltage regulator of claim 8, wherein the sense circuit provides a scaled version of the supply voltage.

10. The voltage regulator of claim 8, wherein at least two of the transconductance amplifiers are coupled in parallel.

11. The voltage regulator of claim 8, wherein at least one of the one or more transconductance amplifiers comprises a control signal, and wherein a state of the control signal determines at least in part, a respective portion of an injection current provided by the at least one of the one or more transconductance amplifiers.

12. The voltage regulator of claim 8, wherein at least one of the one or more transconductance amplifiers comprises a bias device, wherein the bias device determines, at least in part, a respective portion of an injection current provided by the at least one of the one or more transconductance amplifiers.

13. The voltage regulator of claim 12, wherein the voltage regulator core further comprises an output stage comprising an input device and an output device, wherein the input device is coupled to the power supply node and the injection node, and wherein the output device is coupled to the power supply node, the injection node, and the output node, and wherein the input device and the output device have a respective plurality of device design attributes.

14. The voltage regulator of claim 13, wherein an injection current is determined from a supply voltage variation and a gain factor.

15. The voltage regulator of claim 14, wherein the gain factor is determined from at least one of the respective plurality of device design attributes.

16. The voltage regulator of claim 14, wherein the input device comprises an N-type MOSFET transistor having an input transconductance, and wherein the output device comprises a P-type MOSFET transistor having an output transconductance and an output drain transconductance, wherein the gain factor is determined from at least one of the input transconductance, the output transconductance, and the output drain transconductance.

17. The voltage regulator of claim 8, wherein at least one of the transconductance amplifiers is disabled using a control signal.

18. The voltage regulator of claim 8, wherein the sense circuit is coupled to the power supply node, the low pass filter, and the one or more transconductance amplifiers, and wherein the low pass filter is coupled to the sense circuit and the one or more transconductance amplifiers.

19. The voltage regulator of claim 8, wherein the sense circuit senses the supply voltage variation to provide a scaled supply voltage variation to the low pass filter and the one or more transconductance amplifiers.

20. The voltage regulator of claim 19, wherein the low pass filter is coupled to the sense circuit and the one or more transconductance amplifiers to produce a filtered supply voltage variation.

* * * * *